US006935414B2

(12) United States Patent
Kawakubo et al.

(10) Patent No.: US 6,935,414 B2
(45) Date of Patent: Aug. 30, 2005

(54) TUBE AND HEAT EXCHANGER HAVING THE SAME

(75) Inventors: Masaaki Kawakubo, Kariya (JP); Norihide Kawachi, Kariya (JP); Ken Yamamoto, Obu (JP)

(73) Assignee: DENSO Corporation, Kariya (JP)

( * ) Notice: Subject to any disclaimer, the term of this patent is extended or adjusted under 35 U.S.C. 154(b) by 66 days.

(21) Appl. No.: 10/266,236

(22) Filed: Oct. 8, 2002

(65) Prior Publication Data

US 2003/0066636 A1 Apr. 10, 2003

(30) Foreign Application Priority Data

Oct. 9, 2001 (JP) ..... 2001-311678

(51) Int. Cl.[7] ..... F28D 7/16

(52) U.S. Cl. ..... 165/164; 165/110; 165/140; 165/177; 62/335

(58) Field of Search ..... 62/335; 165/140, 165/164, 177

(56) References Cited

U.S. PATENT DOCUMENTS

| | | | | |
|---|---|---|---|---|
| 5,242,015 | A | 9/1993 | Saperstein et al. | |
| 5,372,188 | A * | 12/1994 | Dudley et al. | 165/110 |
| 6,000,467 | A * | 12/1999 | Tokizaki et al. | 165/134.1 |
| 6,032,726 | A * | 3/2000 | Wright et al. | 165/109.1 |
| 6,467,535 | B1 * | 10/2002 | Shembekar et al. | 165/140 |
| 6,540,015 | B1 * | 4/2003 | Kawachi et al. | 165/164 |

FOREIGN PATENT DOCUMENTS

| | | | |
|---|---|---|---|
| JP | 59205591 A * | 11/1984 | F28F/1/02 |
| JP | 2000-346584 | 12/2000 | |

* cited by examiner

*Primary Examiner*—Allen Flanigan
(74) *Attorney, Agent, or Firm*—Harness, Dickey & Pierce, PLC

(57) ABSTRACT

In a tube for a heat exchanger, a plurality of passages is defined. The passages are arranged in rows parallel to a major axis of the tube cross-section and staggered. When the tube is extruded, an extrusion material can flow around dies for forming passages and easily merge between the dies. Since walls between adjacent passages can be easily formed, formability of the tube is improved.

33 Claims, 4 Drawing Sheets

TUBE AND HEAT EXCHANGER HAVING THE SAME

CROSS-REFERENCE TO RELATED APPLICATION

This application is based on Japanese Patent Application No. 2001-311678 filed on Oct. 9, 2001, the disclosure of which is incorporated herein by reference.

FIELD OF THE INVENTION

The present invention relates to a tube and a heat exchanger having the tube, and more particularly, to a heat exchanging tube produced by extrusion and having a plurality of fluid passages arranged in rows.

BACKGROUND OF THE INVENTION

In a heat exchanger disclosed in U.S. Pat. No. 5,242,015, an extruded tube has a plurality of passages. The passages are arranged in a row parallel to a major axis of the tube cross-section. The extruded tube is layered or wound. In this kind of heat exchanger, heat transmission efficiency is likely to be lessened due to voids between surfaces of the layered tube.

Also in U.S. Pat. No. 5,242,015, an extruded tube in which three rows of passages are formed is proposed. In this kind of tube, in a case that the passages are defined into substantially triangular cross-sectional shapes, it is difficult to form walls between the passages in adjacent rows.

For example, as shown in FIG. 10, when a tube in which passages are defined in rows is extruded, an extrusion material flowed between dies in a minor direction of the tube cross-section has to change its flow direction (arrows T) into a major direction of the tube cross-section to reach middle portions S. Therefore, it is difficult to fill between the dies adjacent to the minor direction with the extrusion material.

SUMMARY OF THE INVENTION

The present invention is made in view of the above disadvantages, and it is an object of the present invention to provide a tube in which a plurality of fluid passages is arranged in rows.

It is another object of the present invention to improve formability of the tube.

It is further object of the present invention to provide a heat exchanger having the tube.

According to the present invention, a tube for a heat exchanger has a tube wall defining a plurality of passages therein. The passages extend in a longitudinal direction parallel to the tube wall. The passages are arranged in at least two rows parallel to a major axis of the tube cross-section and are staggered.

Since the passages are staggered, when the tube is extruded, an extrusion material easily flows around dies for defining the passages and reaches between the adjacent dies. Therefore, the walls for defining between the passages in the adjacent rows are properly formed. With this, formability of the tube is improved.

BRIEF DESCRIPTION OF THE DRAWINGS

Other objects, features and advantages of the present invention will become more apparent from the following detailed description made with reference to the accompanying drawings, in which.

DETAILED DESCRIPTION OF PREFERRED EMBODIMENT

Preferred embodiments of the present invention will be described hereinafter with reference to the drawings.

[First Embodiment]

Figure 1:
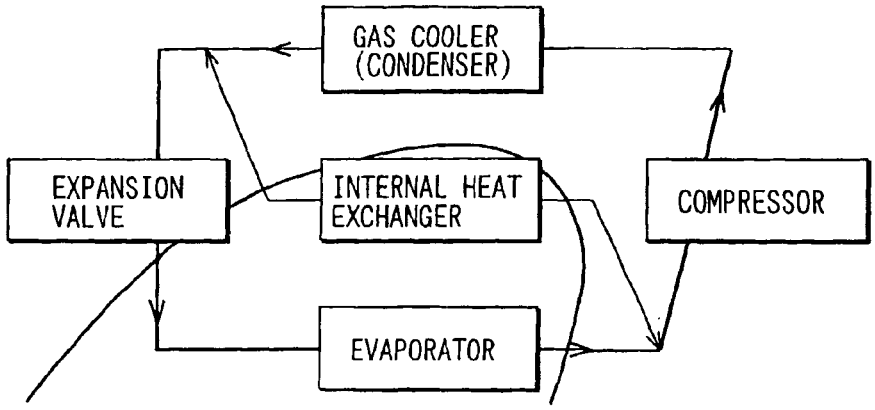
FIG. 1 is a schematic illustration of a refrigerating cycle according to embodiments of the present invention.

A refrigerating cycle generally includes a compressor for compressing a refrigerant, a gas cooler (condenser) for condensing the refrigerant, an expansion valve for reducing pressure of the refrigerant, and an evaporator for evaporating the refrigerant. A refrigerating cycle in FIG. 1 further includes an internal heat exchanger for exchanging heat between a low-temperature, low-pressure refrigerant downstream from the evaporator and a high-temperature, high-pressure refrigerant downstream from the gas cooler.

Figure 2:
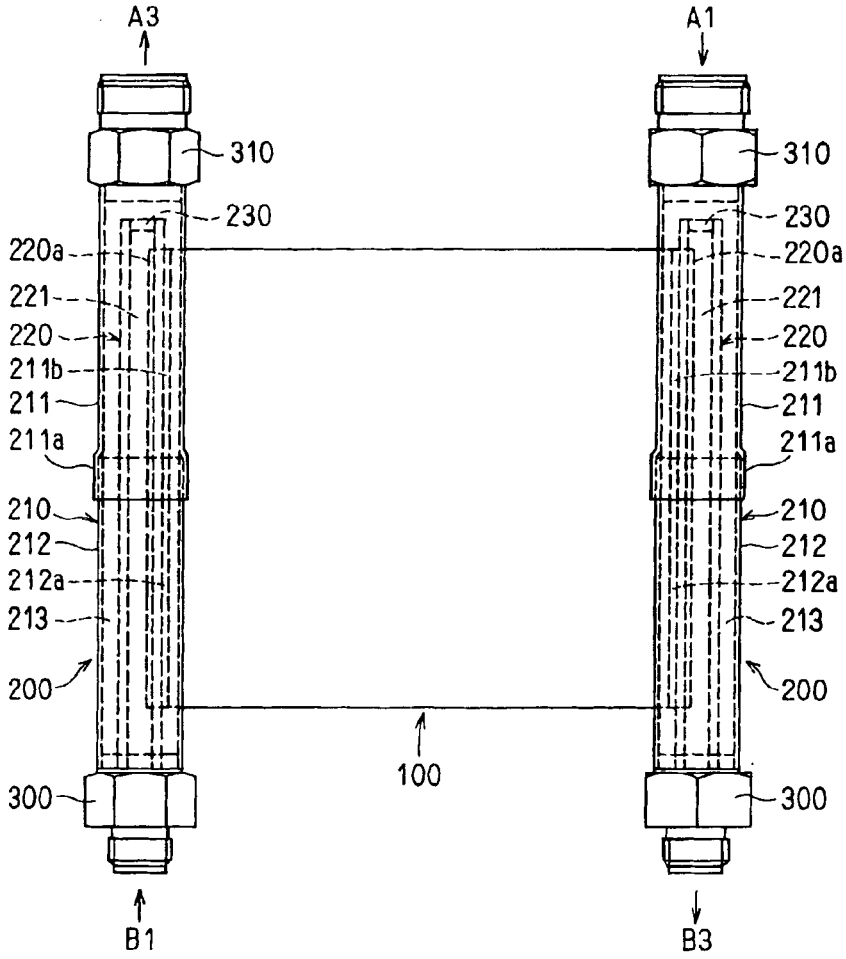
FIG. 2 is a side view of a heat exchanger according to the first embodiment of the present invention.
Figure 3:
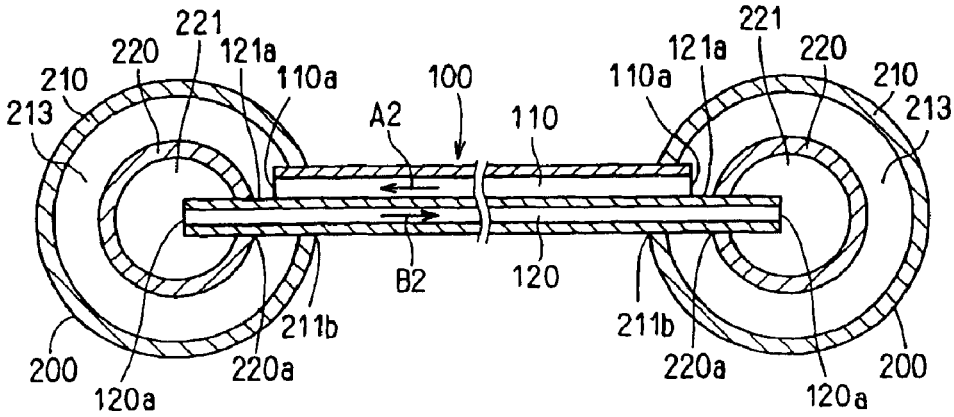
FIG. 3 is a schematic cross-sectional view of the heat exchanger according to the first embodiment of the present invention.

As shown in FIGS. 2 and 3, the internal heat exchanger has a heat exchanging tube 100, double layer pipes 200 and the like. The double layer pipes 200 are located at the ends of the tube 100.

Figure 4:
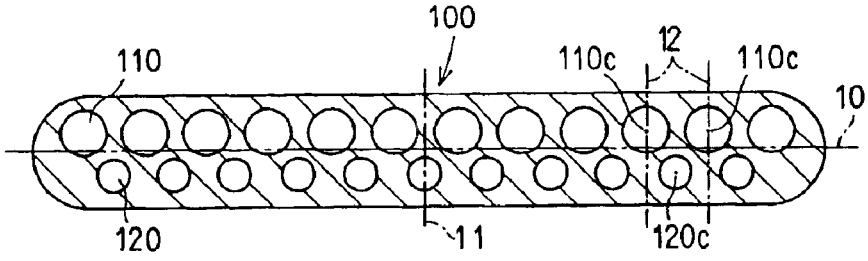
FIG. 4 is a cross-sectional view of a tube for the heat exchanger according to the first embodiment of the present invention.

The heat exchanging tube 100 is a flat tube and has an elliptic-shaped cross-section, as shown in FIG. 4. The tube 100 is formed by extrusion of an aluminum material. A plurality of primary fluid passages 110 in which a primary fluid flows and a plurality of secondary fluid passages 120 in which a secondary fluid flows are formed in the tube 100 by extrusion. As shown in FIG. 3, each of the primary passages 110 has open ends 110*a*, and each of the secondary passages 120 has open ends 120*a*.

The ends of the tubes 100 is cut out such that the primary passages 110 is shorter than the secondary passages 120. The tube 100 has projected portions 121*a*, which project in a fluid flow direction (right and left direction in FIG. 3), at the ends. That is, the open ends 120*a* are located outside from the open ends 110*a* in the fluid flow direction.

Each of the double layer pipes 200 has an outer (first) header pipe 210 and an inner (second) header pipe 220. The inner header pipe 220 is located in the outer header pipe 210. Each of the outer header pipes 210 has a cylindrical-shaped first pipe (upper pipe in FIG. 2) 211 and second pipe (lower pipe in FIG. 2) 212. The first and second pipes 211 and 212 are made of an aluminum material. The first pipe 211 has an insertion portion 211*a* at a lower end. An inner diameter of the insertion portion 211*a* is increased, so that an end of the second pipe 212 is inserted in the insertion portion 211*a*.

The first pipe 211 has a longitudinal aperture 211*b* on its cylindrical surface and the second pipe 212 has a longitudinal aperture 212*a* on its cylindrical surface, so that the outer header pipe 210 has a longitudinal aperture.

The inner header pipe 220 is made of an aluminum material. The inner header pipe 220 has a cylindrical shape. The outer diameter of the inner header pipe 220 is smaller than the inner diameter of the outer header pipe 210. The inner header pipe 220 has a longitudinal aperture 220*a*, which is a same length as the longitudinal aperture of the outer header pipe 210, on its cylindrical surface. An aluminum cap 230 is brazed on the end (top end in FIG. 2) of the inner header pipe 220, to close the end of the inner header pipe 220.

The internal heat exchanger is assembled in the following manner. First, lower unions 300, each having an inner diameter same as the inner diameter of the inner header pipe 220, are placed at the ends (lower ends in FIG. 2) of the inner header pipes 220. Then, the second pipes 212 of the outer header pipes 210 are placed on the unions 300. At this time, spacers (not shown) are placed between the inner header pipes 220 and the second pipes 212, so that the second pipes 212 are concentrically positioned with the unions 300.

Then, the ends of the tube 100 are inserted in the apertures 212*a* of the second pipes 212, as shown in FIGS. 2 and 3. The projected portions 121*a* of the secondary passages 120 are inserted in the apertures 220*a* of the inner header pipes 220. The first pipes 211 are placed such that the ends of the tube 100 are inserted in the apertures 211*b* of the first pipes 211 and the ends of the second pipes 212 are inserted in the insertion portions 211*a* of the first pipes 211.

Figure 5:
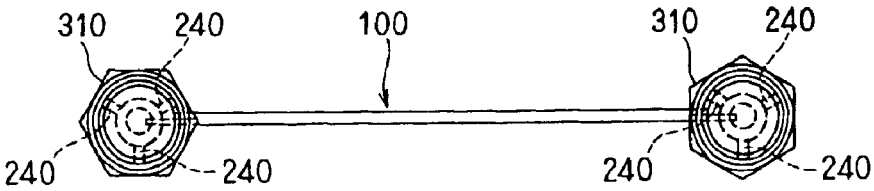
FIG. 5 is an end view of the heat exchanger according to the first embodiment of the present invention.

Then, as shown in FIG. 5, three spacers 240 are placed between the inner header pipe 220 and the first pipe 211, so that the first pipes 211 are positioned in a radial direction with respect to the inner header pipes 220. Further, upper unions 310, each having an inner diameter same as the inner diameter of the first pipe 211, are placed on the ends (top ends in FIG. 2) of the first pipes 211. The double layer pipes 200 and the tube 100 joined as above are integrally brazed in a heating furnace.

In each double layer pipe 200, an outer passage 213 is defined between the outer header pipe 210 and inner header pipe 220, and an inner passage 221 is defined in the inner header pipe 220. The upper unions 310 communicate only with the outer passages 213. The lower unions 300 communicate only with the inner passages 221. The open ends 110*a* of the primary passages 110 communicate with the outer passages 213 and the open ends 120*a* of the secondary passages 120 communicate with the inner passages 221.

The primary fluid and secondary fluid flow in the internal heat exchanger as shown by arrows in FIGS. 2 and 3. As shown by arrow A1, the primary fluid flows into the outer passage 213 from the upper union 310 (right side union 310 in FIG. 2). Then, the primary fluid is distributed to the open ends 110*a* of one end of the tube 100. The primary fluid flows in the primary passages 110 toward the opposite side open ends 110*a* of the tube 100 as shown by arrow A2. Then, the primary fluid is collected in the outer passage 213 and discharged from the opposite union 310 as shown by arrow A3.

The secondary fluid flows into the inner passage 221 from one of the lower unions 300 (left side union 300 in FIG. 2), as shown by arrow B1. The secondary fluid is distributed to the open ends 120*a* of the secondary fluid passages 120. Then, the secondary fluid flows in the secondary fluid passages in a direction shown by arrow B2 toward the opposite side open ends (right side in FIG. 2) 120*a*. The secondary fluid is collected in the inner passage 221 and discharged from the opposite union 300 as shown by arrow B3. Here, as shown by arrow A2 and B2, the primary fluid and secondary fluid flow in opposite directions.

The internal heat exchanger is used for exchanging heat between refrigerants of such as HFC134a or $CO_2$. The primary fluid is the low-temperature, low-pressure refrigerant downstream from the evaporator. The secondary fluid is the high-temperature, high-pressure refrigerant downstream from the gas cooler. Since the pressure withstand of the inner header pipes 220 against the internal fluid pressure is greater than that of the outer header pipes 210, the secondary fluid of high pressure is provided to flow in the inner passages 221.

Figure 6:
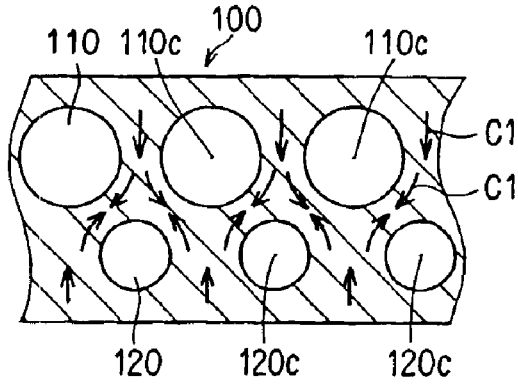
FIG. 6 is an enlarged partial cross-sectional view of the tube according to the first embodiment of the present invention.

As shown in FIGS. 4 and 6, the primary fluid passages 110 and secondary fluid passages 120 are arranged in at least two rows substantially parallel to a major axis 10 of the tube cross-section. Further, the primary passages 110 and secondary passages 120 are staggered. In the tube-cross section, centerlines 12 of the centers 110*c* of the primary fluid passages 110 pass between the centers 120*c* of the secondary fluid passages 120. The centerlines are substantially parallel to a minor axis 11 of the tube cross-section.

Therefore, when the tube 100 is formed by extrusion of the aluminum material and the like, the extrusion material flows around dies for forming the fluid passages 110, 120 in directions shown by arrows C1 and merges between the adjacent dies. Accordingly, the walls between the rows, that is, the walls for defining between the primary passages 110 and secondary passages 120 are easily formed. Because formability of the tube 100 is improved, the tube 100 in which plurality of passages are arranged in rows can be formed by extrusion.

The fluid passages 110, 120 are defined into substantially circular cross-sectional shapes. Also, the primary fluid passages 110 and the secondary fluid passages 120 are staggered such that the centerlines 12 of the centers 110*c* of the circular shapes of the primary passages 110 pass between the centers 120*c* of the circular shapes of the secondary passages 120. With this, since the flowability of the extrusion material is improved, the extrusion becomes easy. Further, pressure tightness of the walls defining the fluid passages 110, 120 can be improved.

In the tube 100, the primary fluid of low-pressure flows in the primary passages 110, the secondary fluid of high-pressure flows in the secondary passages 120. Heat is exchanged between the primary fluid and the secondary fluid when flowing in the fluid passages 110 and 120. In the tube 100, a total cross-sectional area of the primary passages 110 is larger than that of the secondary passages 120. Therefore, pressure loss of the primary passages 110 is decreased. Because a flow rate of the primary fluid flowing in the primary passages 110 is substantially equal to that of the secondary fluid flowing in the secondary passages 120. Therefore, heat exchanging performance is improved.

Because the diameter of each primary passage 110 is larger than that of each secondary passage 120, the total cross-sectional area of the primary passage 110 is larger than that of the secondary passages 120. Alternatively, the number of the primary passages 110 is larger than that of the secondary passages 120, so that the total cross-sectional area of the primary passages 110 is larger than that of the secondary passages 120.

[Second Embodiment]

Figure 7A:
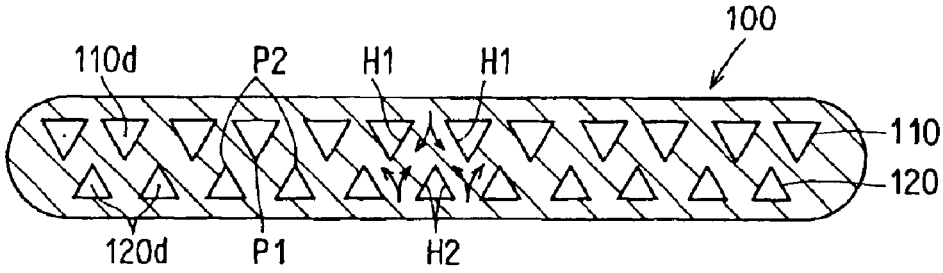
FIG. 7A is a cross-sectional view of a tube for the heat exchanger according to the second embodiment of the present invention.
Figure 7B:
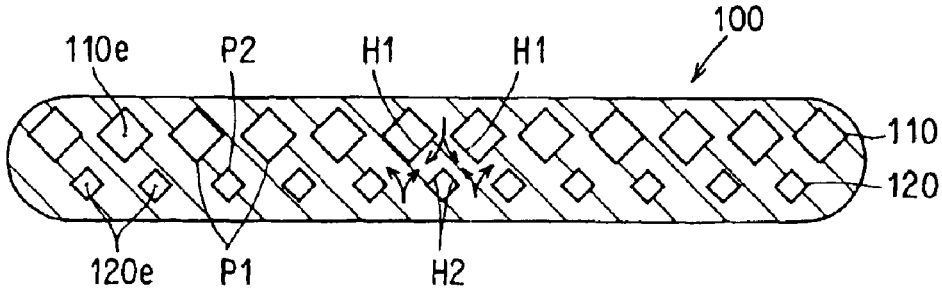
FIG. 7B is a cross-sectional view of a tube for the heat exchanger according to the second embodiment of the present invention.

In the second embodiment, the primary and secondary passages 110, 120 are defined into substantially triangular cross-sectional shapes, as shown in FIG. 7A. Alternatively, the primary and secondary passages 110, 120 are defined into substantially diamond or substantially rectangular cross-sectional shapes, as shown in FIG. 7B. Similar to the first embodiment, the primary passages 110 and secondary passages 120 are arranged in rows substantially parallel to the major axis 10 of the tube cross-section. The primary passages 110 and secondary passages 120 are staggered such that the centerlines of the centers 110*d* of the triangular shapes pass between the centers 120*d* of the triangular shapes, and the centerlines of the centers 110*e* of the diamond shapes are between the centers 120*e* of the diamond shapes.

In addition, the primary passages 110 and secondary passages 120 are arranged such that vertexes P1 of the triangular shapes or diamond shapes of the primary passages 110 are opposite to the vertex P2 of the triangular shapes or diamond shapes of the secondary passages 120 in the minor direction of the tube cross-section. Further, sides H1 of the triangular or diamond-shaped primary passages 110 are substantially parallel to sides H2 of the triangular or diamond-shaped secondary passages 120. With this, when the tube 100 is extruded, the extrusion material can easily flow between the parallel sides H1 and H2 and merge between the sides H1 and H2. Therefore, the walls defining between the passages 110, 120 can be properly formed.

[Third Embodiment]

Figure 8:
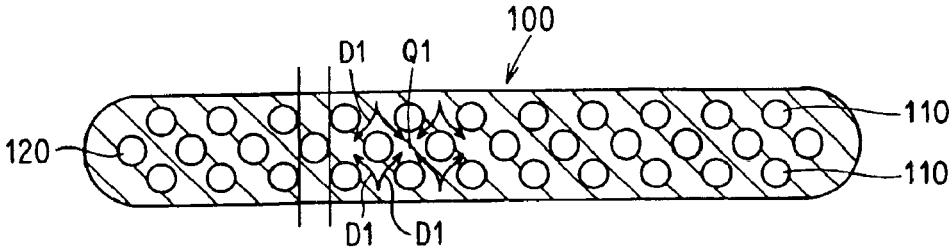
FIG. 8 is a cross-sectional view of a tube for a heat exchanger according to the third embodiment of the present invention.

In the third embodiment, the fluid passages 110, 120 are arranged in three rows substantially parallel to the major axis 10 of the tube cross-section. The row of the secondary passages 120 is between the rows of the primary passages 110, as shown in FIG. 8. The cross-sectional areas of the passages 110 and 120 are substantially equal. Further, the primary passages 110 do not overlap with the secondary passages 120 in the minor direction (perpendicular in FIG. 8).

When the tube 100 is extruded, the extrusion material flowed between the dies for forming the primary passages 110 in the minor direction slightly changes its flow direction as shown by arrows D1, and further flows between the dies for forming the secondary passages 120. Since the dies in adjacent two rows are arranged without overlapping in the minor direction, the extrusion material can merge at the central portion Q1 between the dies. Therefore, the walls for defining between the passages 110 and 120 can be easily formed.

Figure 9:
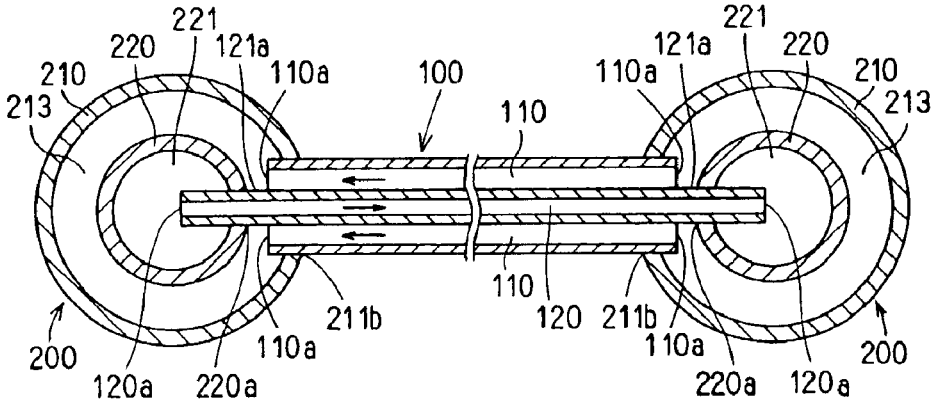
FIG. 9 is a schematic cross-sectional view of a heat exchanger according to the third embodiment of the present invention.
Figure 10:
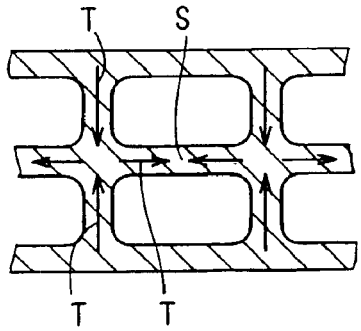
FIG. 10 RELATED ART
FIG. 10 is a partial enlarged cross-sectional view of an extruded tube of a related art.

As shown in FIG. 9, in the heat exchanger having the tube 100, the ends 110*a* of the primary passages 110 in both the rows communicate with the outer passages 213. The ends 120*a* of the secondary passages 120 communicate with the inner passages 221. The total cross-sectional area of the primary passages 110 for the low-temperature refrigerant is larger than that of the secondary passages 120 for the high-temperature refrigerant.

In the above-described embodiments, the tube 100 is used for exchanging heat between the refrigerants. However, it can be used to exchange heat between water and a refrigerant such as in a hot-water supplying device. Further, although the primary fluid and the secondary fluid are countercurrent-flow, they can be parallel-flow.

The present invention should not be limited to the disclosed embodiments, but may be implemented in other ways without departing from the spirit of the invention.

What is claimed is:

1. A tube for a heat exchanger comprising:

an extruded tube wail defining a plurality of passages extending in a longitudinal direction parallel to the tube wall, wherein the plurality of passages are arranged in at least two rows substantially parallel to a major axis of the tube cross-section and are staggered, wherein a first line passes through midpoints of line segments which pass through the passages of a first row and a second line passes through midpoints of line segments which pass through the passages of a second row, the line segments being parallel to a minor axis of the tube cross-section, wherein the first line and the second line are offset from each other, and wherein straight lines pass between adjacent passages in the first row and adjacent passages in the second row without intersecting the passages, the straight lines extending from a first side of the tube wall to a second side of the tube wall, the first side being opposite to the second side.

2. The tube according to claim 1, wherein the passages are defined into substantially circular cross-sectional shapes.

3. A tube for a heat exchanger comprising:

an extruded tube wall defining a plurality of passages extending in a longitudinal direction parallel to the tube wall, wherein the plurality of passages is arranged in at least two rows substantially parallel to a major axis of the tube cross-section and is staggered; wherein the passages are defined into substantially circular cross-sectional shapes; and the passages in adjacent rows are arranged such that centerlines of the circular shapes in a first row pass between centers of the circular shapes in a second row, the centerlines being parallel to a minor axis of the tube cross-section.

4. The tube according to claim 1, wherein the passages are defined into substantially triangular cross-sectional shapes.

5. The tube according to claim 4, wherein the passages in adjacent rows are arranged such that the triangular shapes in a first row are opposite to the triangular shapes in a second row in a minor direction and sides of the triangular shapes in the first row are parallel to sides of the triangular shapes in the second row.

6. The tube according to claim 1, wherein the, passages are defined into substantially diamond cross-sectional shapes, wherein the passages in adjacent rows are arranged such that sides of the diamond shapes in a first row are parallel to sides of the diamond shapes in a second row.

7. The tube according to claim 1, wherein the plurality of passages includes primary passages through which a primary fluid flows and secondary passages through which a secondary fluid flows to exchange heat between the primary fluid and the secondary fluid, wherein the first fluid has a pressure different from that of the secondary fluid, and wherein a total cross-sectional area of the primary passages is larger than that of the secondary passages.

8. A heat exchanging device comprising a tube defining primary passages through which a primary fluid flows and secondary passages through which a secondary fluid flows, the primary fluid having a pressure different from that of the second fluid, wherein heat is exchanged between the primary fluid and the secondary fluid, and wherein the primary passages and the secondary passages are staggered in at least two rows, wherein a first line passes through midpoints of line segments which pass through the passages of a first row and a second line passes through midpoints of line segments which pass through the passages of a second row, the line segments being parallel to a minor axis of the tube cross-section, wherein the first line and the second line are offset from each other, and wherein straight lines pass between adjacent passages in the first row and adjacent passages in the second row without intersecting the passages, the straight lines extending from a first side of the tube wall to a second side of the tube wall, the first side being opposite to the second side.

9. The heat exchanging device according to claim 8, wherein a total cross-sectional area of the primary passages is larger than that of the secondary passages.

10. The heat exchanging device according to claim 8, wherein a cross-sectional area of each primary passage is larger than that of each secondary passage.

11. The heat exchanging device according to claim 8, wherein a number of the primary passages is larger than that of the secondary passages.

12. The heat exchanging device according to claim 8, wherein a length of the primary passage is shorter than that of the secondary passage.

13. The heat exchanging device according to claim 8, wherein the primary fluid and secondary fluid are carbon dioxide.

14. The heat exchanging device according to claim 8, wherein the tube is formed by extrusion.

15. The tube according to claim 1, wherein a distance between the first line and the second line is greater than half of a cross-sectional passage dimension parallel to the minor axis.

16. The tube according to claim 1, wherein the first row of passages and the second row of passages are arranged without overlapping passages with respect to a direction parallel to the major axis of the tube cross-section.

17. The tube according to claim 1, wherein the passages have circular shapes and adjacent rows are arranged such that centerlines of the circular shapes in the first row pass between centers of the circular shapes in the second row, the centerlines being parallel to the minor axis of the tube cross-section.

18. The tube according to claim 3, wherein the first row of passages and the second row of passages are arranged without overlapping passages with respect to a direction parallel to the major axis of the tube cross-section.

19. The heat exchanging device according to claim 8, wherein the first row of passages and the second row of passages are arranged without overlapping passages with respect to a direction parallel to the major axis of the tube cross-section.

20. The heat exchanging device according to claim 8, further comprising:

a first header pipe defining an outer passage space through which the primary fluid flows and an inner passage space through which the secondary fluid flows; and a secondary header pipe defining an outer passage space through which the primary fluid flows and an inner passage space through which the secondary fluid flows, wherein the first header pipe and the second header pipe are connected to a first end and a second end of the tube, respectively, such that the passages in the first row communicate with the outer passage spaces and the passages in the second row communicate with the inner passage spaces.

21. A tube for a heat exchanger, comprising:

an extruded tube wall defining a plurality of passages extending in a longitudinal direction parallel to the tube wall, wherein the plurality of passages are arranged in at least two rows substantially parallel to a major axis of the tube cross-section and are staggered, wherein a first line passes through midpoints of line segments which pass through the passages of a first row and a second line passes through midpoints of line segments which pass through the passages of a second row, the line segments being parallel to a minor axis of the tube cross-section, wherein the first line and the second line are offset from each other, and wherein the passages are defined into substantially circular cross-sectional shapes.

22. The tube according to claim 1, wherein a distance between the first line and the second line is greater than half of a cross-sectional passage dimension parallel to the minor axis.

23. The tube according to claim 1, wherein the first row of passages and the second row of passages are arranged without overlapping passages with respect to a direction parallel to the major axis of the tube cross-section.

24. The tube according to claim 1, wherein adjacent rows of the passages are arranged such that centerlines of the circular shapes in the first row pass between centers of the circular shapes in the second row, the centerlines being parallel to the minor axis of the tube cross-section.

25. A tube for a heat exchanger, comprising:

an extruded tube wall defining a plurality of passages extending in a longitudinal direction parallel to the tube wall, wherein the plurality of passages are arranged in at least two rows substantially parallel to a major axis of the tube cross-section and are staggered, wherein a first line passes through midpoints of line segments which pass through the passages of a first row and a second line passes through midpoints of line segments which pass through the passages of a second row, the line segments being parallel to a minor axis of the tube cross-section, wherein the first line and the second line are offset from each other, wherein the plurality of passages includes primary passages through which a primary fluid flows and secondary passages through which a secondary fluid flows to exchange heat between the primary fluid and the secondary fluid, wherein the first fluid has a pressure different from that of the secondary fluid, and wherein a total cross-sectional area of the primary passages is larger than that of the secondary passages.

26. A heat exchanging device comprising:

a tube defining primary passages through which a primary fluid flows and secondary passages through which a secondary fluid flows, the primary fluid having a pressure different from that of the second fluid, wherein heat is exchanged between the primary fluid and the secondary fluid, and wherein the primary passages and the secondary passages are staggered in at least two rows, wherein a first line passes through midpoints of line segments which pass through the passages of a first row and a second line passes through midpoints of line, segments which pass through the passages of a second row, the line segments being parallel to a minor axis of the tube cross-section, wherein the first line and the second line are offset from each other;

a first header pipe defining an outer passage space through which the primary fluid flows and an inner passage space through which the secondary fluid flows; and a secondary header pipe defining an outer passage space through which the primary fluid flows and an inner passage space through which the secondary fluid flows, wherein the first header pipe and the second header pipe are connected to a first end and a second end of the tube, respectively, such that the passages in the first row communicate with the outer passage spaces and the passages in the second row communicate with the inner passage spaces.

27. The heat exchanging device according to claim 26, wherein a total cross-sectional area of the primary passages is larger than that of the secondary passages.

28. The heat exchanging device according to claim 26, wherein a cross-sectional area of each primary passage is larger than that of each secondary passage.

29. The heat exchanging device according to claim 26, wherein a number of the primary passage is larger than that of the secondary passages.

30. The heat exchanging device according to claim 26, wherein a length of primary passage is shorter than that of the secondary passage.

31. The heat exchanging device according to claim 26, wherein the primary fluid and secondary fluid are carbon dioxide.

32. The heat exchanging device according to claim 26, wherein the tube is formed by extrusion.

33. The heat exchanging device according to claim 26, wherein the first row of passages and the second row of passages are arranged without overlapping passages with respect to a direction parallel to the major axis of the tube cross-section.

* * * * *